US010659899B2

(12) United States Patent
Lando et al.

(10) Patent No.: US 10,659,899 B2
(45) **Date of Patent: *May 19, 2020**

(54) METHODS AND SYSTEMS FOR RENDERING AUDIO BASED ON PRIORITY

(71) Applicant: DOLBY LABORATORIES LICENSING CORPORATION, San Francisco, CA (US)

(72) Inventors: Joshua Brandon Lando, San Francisco, CA (US); Freddie Sanchez, Berkeley, CA (US); Alan J Seefeldt, Alameda, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/225,126

(22) Filed: Dec. 19, 2018

(65) Prior Publication Data

US 2019/0191258 A1 Jun. 20, 2019

Related U.S. Application Data

(63) Continuation of application No. 15/532,419, filed as application No. PCT/US2016/016506 on Feb. 4, 2016, now Pat. No. 10,225,676.

(Continued)

(51) Int. Cl.

*H04S 3/00* (2006.01)
*G10L 19/008* (2013.01)

(Continued)

(52) U.S. Cl.

CPC ..... *H04S 3/008* (2013.01); *G10L 19/008* (2013.01); *G10L 19/20* (2013.01); *H04R 5/02* (2013.01);

(Continued)

(58) Field of Classification Search

CPC ..... H04S 3/008; H04S 7/302; H04S 2400/11; H04S 2420/03; G10L 19/008;

(Continued)

(56) References Cited

U.S. PATENT DOCUMENTS 5,633,993 A 5/1997 Redmann
7,706,544 B2 4/2010 Melchior (Continued)

FOREIGN PATENT DOCUMENTS

CN 103650535 3/2014
JP H09-149499 6/1997

(Continued)

OTHER PUBLICATIONS

Vercoe B., "Audio-Pro with Multiple DSPS and Dynamic Load Distribution", BT Technology Journal, Springer Dordrecht NL, vol. 22 No. , Oct. 4, 2004.

*Primary Examiner* — Jason R Kurr

(57) ABSTRACT

Embodiments are directed to a method of rendering adaptive audio by receiving input audio comprising channel-based audio, audio objects, and dynamic objects, wherein the dynamic objects are classified as sets of low-priority dynamic objects and high-priority dynamic objects, rendering the channel-based audio, the audio objects, and the low-priority dynamic objects in a first rendering processor of an audio processing system, and rendering the high-priority dynamic objects in a second rendering processor of the audio processing system. The rendered audio is then subject to virtualization and post-processing steps for playback through soundbars and other similar limited height capable speakers.

20 Claims, 12 Drawing Sheets

Related U.S. Application Data

(60) Provisional application No. 62/113,268, filed on Feb. 6, 2015.

(51) Int. Cl.

| | |
|---|---|
| ***H04R 5/02*** | (2006.01) |
| ***G10L 19/20*** | (2013.01) |
| *H04R 1/40* | (2006.01) |
| *G10L 19/16* | (2013.01) |
| *H04R 27/00* | (2006.01) |
| *H04S 7/00* | (2006.01) |

(52) U.S. Cl.
CPC ..... *G10L 19/167* (2013.01); *H04R 1/403* (2013.01); *H04R 27/00* (2013.01); *H04R 2499/13* (2013.01); *H04S 7/302* (2013.01); *H04S 2400/11* (2013.01); *H04S 2420/03* (2013.01)

(58) Field of Classification Search
CPC ..... G10L 19/20; G10L 19/167; H04R 5/02; H04R 1/403; H04R 27/00; H04R 2499/13
See application file for complete search history.

(56) References Cited

U.S. PATENT DOCUMENTS

| | | | | |
|---|---|---|---|---|
| 8,160,258 | B2 | 4/2012 | Jung | |
| 8,285,556 | B2 | 10/2012 | Jung | |
| 8,363,865 | B1 | 1/2013 | Bottum | |
| 8,396,576 | B2 * | 3/2013 | Kraemer | G10L 19/00 700/94 |
| 8,639,498 | B2 | 1/2014 | Beack | |
| 8,718,285 | B2 * | 5/2014 | Ishikawa | H04L 12/40013 381/22 |
| 2011/0040395 | A1 * | 2/2011 | Kraemer | G10L 19/00 700/94 |
| 2012/0078642 | A1 | 3/2012 | Seo | |
| 2012/0177204 | A1 | 7/2012 | Hellmuth | |
| 2012/0230497 | A1 * | 9/2012 | Dressler | H04S 3/02 381/22 |
| 2012/0232910 | A1 | 9/2012 | Dressler | |
| 2012/0288012 | A1 * | 11/2012 | Staikos | G06F 9/5038 375/240.25 |
| 2015/0016642 | A1 * | 1/2015 | Walsh | H04S 7/301 381/307 |
| 2015/0255076 | A1 | 9/2015 | Fejzo | |
| 2015/0350802 | A1 | 12/2015 | Jo | |

FOREIGN PATENT DOCUMENTS

| | | |
|---|---|---|
| JP | 2013544046 | 12/2013 |
| WO | 2007/091842 | 8/2007 |
| WO | 2010/017967 | 2/2010 |
| WO | 2011/020065 | 2/2011 |
| WO | 2012/125855 | 9/2012 |
| WO | 2013/108200 | 7/2013 |
| WO | 2014/020181 | 2/2014 |
| WO | 2014/023443 | 2/2014 |
| WO | 2014/099285 | 6/2014 |

* cited by examiner

1000

| METADATA TYPE | METADATA ELEMENTS |
|---|---|
| AUDIO CONTENT TYPE | Dialog/Music/Ambient/Effects<br>Direct/Diffuse/Reflected |
| DRIVER DEFINITIONS | Soundbar Configuration<br>Surround Speaker Configuration |
| DECODER TYPE | Digital Plus<br>TrueHD<br>MAT 2.0<br>Optional SRC |
| DYNAMIC OBJECT PRIORITY | Scalar Value<br>Binary Flag |

FIG. 10

METHODS AND SYSTEMS FOR RENDERING AUDIO BASED ON PRIORITY

CROSS-REFERENCE TO RELATED APPLICATIONS

This application is continuation of Ser. No. 15/532,419, filed Jun. 1, 2017, which is U.S. National Stage of PCT/US2016/016506, filed Feb. 4, 2016, which claims priority to U.S. Provisional Application No. 62/113,268, filed Feb. 6, 2015, each hereby incorporated by reference in its entirety.

FIELD OF THE INVENTION

One or more implementations relate generally to audio signal processing, and more specifically to a hybrid, priority based rendering strategy for adaptive audio content.

BACKGROUND

The introduction of digital cinema and the development of true three-dimensional ("3D") or virtual 3D content has created new standards for sound, such as the incorporation of multiple channels of audio to allow for greater creativity for content creators and a more enveloping and realistic auditory experience for audiences. Expanding beyond traditional speaker feeds and channel-based audio as a means for distributing spatial audio is critical, and there has been considerable interest in a model-based audio description that allows the listener to select a desired playback configuration with the audio rendered specifically for their chosen configuration. The spatial presentation of sound utilizes audio objects, which are audio signals with associated parametric source descriptions of apparent source position (e.g., 3D coordinates), apparent source width, and other parameters. Further advancements include a next generation spatial audio (also referred to as "adaptive audio") format has been developed that comprises a mix of audio objects and traditional channel-based speaker feeds along with positional metadata for the audio objects. In a spatial audio decoder, the channels are sent directly to their associated speakers or down-mixed to an existing speaker set, and audio objects are rendered by the decoder in a flexible (adaptive) manner. The parametric source description associated with each object, such as a positional trajectory in 3D space, is taken as an input along with the number and position of speakers connected to the decoder. The renderer then utilizes certain algorithms, such as a panning law, to distribute the audio associated with each object across the attached set of speakers. The authored spatial intent of each object is thus optimally presented over the specific speaker configuration that is present in the listening room.

The advent of advanced object-based audio has significantly increased the complexity of the rendering process and the nature of the audio content transmitted to various different arrays of speakers. For example, cinema sound tracks may comprise many different sound elements corresponding to images on the screen, dialog, noises, and sound effects that emanate from different places on the screen and combine with background music and ambient effects to create the overall auditory experience. Accurate playback requires that sounds be reproduced in a way that corresponds as closely as possible to what is shown on screen with respect to sound source position, intensity, movement, and depth.

Although advanced 3D audio systems (such as the Dolby® Atmos™ system) have largely been designed and deployed for cinema applications, consumer level systems are being developed to bring the cinematic adaptive audio experience to home and office environments. As compared to cinemas, these environments pose obvious constraints in terms of venue size, acoustic characteristics, system power, and speaker configurations. Present professional level spatial audio systems thus need to be adapted to render the advanced object audio content to listening environments that feature different speaker configurations and playback capabilities. Toward this end, certain virtualization techniques have been developed to expand the capabilities of traditional stereo or surround sound speaker arrays to recreate spatial sound cues through the use of sophisticated rendering algorithms and techniques such as content-dependent rendering algorithms, reflected sound transmission, and the like. Such rendering techniques have led to the development of DSP-based renderers and circuits that are optimized to render different types of adaptive audio content, such as object audio metadata content (OAMD) beds and ISF (Intermediate Spatial Format) objects. Different DSP circuits have been developed to take advantage of the different characteristics of the adaptive audio with respect to rendering specific OAMD content. However, such multi-processor systems require optimization with respect to memory bandwidth and processing capability of the respective processors.

What is needed, therefore is a system that provides a scalable processor load for two or more processors in a multi-processor rendering system for adaptive audio.

The increased adoption of surround-sound and cinema-based audio in homes has also led development of different types and configurations of speakers beyond the standard two-way or three-way standing or bookshelf speakers. Different speakers have been developed to playback specific content, such as soundbar speakers as part of a 5.1 or 7.1 system. Soundbars represent a class of speaker in which two or more drivers are collocated in a single enclosure (speaker box) and are typically arrayed along a single axis. For example, popular soundbars typically comprise 4-6 speakers that are lined up in a rectangular box that is designed to fit on top of, underneath, or directly in front of a television or computer monitor to transmit sound directly out of the screen. Because of the configuration of soundbars, certain virtualization techniques may be difficult to realize, as compared to speakers that provide height cues through physical placement (e.g., height drivers) or other techniques.

What is further needed, therefore, is a system that optimizes adaptive audio virtualization techniques for playback through soundbar speaker systems.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Dolby, Dolby TrueHD, and Atmos are trademarks of Dolby Laboratories Licensing Corporation.

BRIEF SUMMARY OF EMBODIMENTS

Embodiments are described for a method of rendering adaptive audio by receiving input audio comprising channel-based audio, audio objects, and dynamic objects, wherein the dynamic objects are classified as sets of low-priority dynamic objects and high-priority dynamic objects; rendering the channel-based audio, the audio objects, and the low-priority dynamic objects in a first rendering processor of an audio processing system; and rendering the high-priority dynamic objects in a second rendering processor of the audio processing system. The input audio may be formatted in accordance with an object audio based digital bitstream format including audio content and rendering metadata. The channel-based audio comprises surround-sound audio beds, and the audio objects comprise objects conforming to an intermediate spatial format. The low-priority dynamic objects and high-priority dynamic objects are differentiated by a priority threshold value that may be defined by one of: an author of audio content comprising the input audio, a user selected value, and an automated process performed by the audio processing system. In an embodiment, the priority threshold value is encoded in the object audio metadata bitstream. The relative priority of audio objects of the low-priority and high-priority audio objects may be determined by their respective position in the object audio metadata bitstream.

In an embodiment, the method of further comprises passing the high-priority audio objects through the first rendering processor to the second rendering processor during or after the rendering of the channel-based audio, the audio objects, and the low-priority dynamic objects in the first rendering processor to produce rendered audio; and post-processing the rendered audio for transmission to a speaker system. The post-processing step comprises at least one of upmixing, volume control, equalization, bass management, and a virtualization step to facilitate the rendering of height cues present in the input audio for playback through the speaker system.

In an embodiment, the speaker system comprises a soundbar speaker having a plurality of collocated drivers transmitting sound along a single axis, and the first and second rendering processors are embodied in separate digital signal processing circuits coupled together through a transmission link. The priority threshold value is determined by at least one of: relative processing capacities of the first and second rendering processors, memory bandwidth associated with each of the first and second rendering processors, and transmission bandwidth of the transmission link.

Embodiments are further directed to a method of rendering adaptive audio by receiving an input audio bitstream comprising audio components and associated metadata, the audio components each having an audio type selected from: channel-based audio, audio objects, and dynamic objects; determining a decoder format for each audio component based on a respective audio type; determining a priority of each audio component from a priority field in metadata associated with the each audio component; rendering a first priority type of audio component in a first rendering processor; and rendering a second priority type of audio component in a second rendering processor. The first rendering processor and second rendering processors are implemented as separate rendering digital signal processors (DSPs) coupled to one another over a transmission link. The first priority type of audio component comprises low-priority dynamic objects and the second priority type of audio component comprises high-priority dynamic objects, the method further comprising rendering the channel-based audio, the audio objects in the first rendering processor. In an embodiment, the channel-based audio comprises surround-sound audio beds, the audio objects comprise objects conforming to an intermediate spatial format (ISF), and the low and high-priority dynamic objects comprise conforming to an object audio metadata (OAMD) format. The decoder format for each audio component generates at least one of: OAMD formatted dynamic objects, surround-sound audio beds, and ISF objects. The method may further comprise applying virtualization processes to at least the high-priority dynamic objects to facilitate the rendering of height cues present in the input audio for playback through the speaker system, and the speaker system may comprise a soundbar speaker having a plurality of collocated drivers transmitting sound along a single axis.

Embodiments are directed to methods and systems for rendering adaptive audio. The method(s) may receive input audio comprising at least a dynamic object. The dynamic object is classified as either a low-priority dynamic object or a high-priority dynamic objects based on a priority value. The dynamic object may then be rendered, wherein low-priority objects are rendered using a first rendering processing and high-priority objects are rendered using a second rendering processing. The first rendering process is different than a second rendering process for high priority objects and the rendering includes classifying the dynamic object as either a low-priority object or a high-priority object based on a comparison of the priority value with a priority threshold value. The rendering includes choosing either the first rendering process or the second rendering process based on the classification.

Likewise, the system for rendering adaptive audio may include an interface for receiving input audio in a bitstream having audio content and associated metadata, the audio content comprising dynamic objects, wherein the dynamic objects are classified as low-priority dynamic objects and high-priority dynamic objects. The system may further include a rendering processor coupled to the interface and configured to render the dynamic object, wherein low-priority objects are rendered using a first rendering processing and high-priority objects are rendered using a second rendering processing. The first rendering process is different than a second rendering process for high priority objects. The rendering includes classifying the dynamic object as either a low-priority object or a high-priority object based on a comparison of the priority value with a priority threshold value. The rendering further includes choosing either the first rendering process or the second rendering process based on the classification.

The input audio may be formatted in accordance with an object audio based digital bitstream format including audio content and rendering metadata. The method or system may further include receiving channel-based audio comprises surround-sound audio beds, and audio objects conforming to an intermediate spatial format. The method or system may further include post-processing the rendered audio for transmission to a speaker system. The post processing may comprise least one of upmixing, volume control, equalization, and bass management. The post-processing may further comprise a virtualization step to facilitate the rendering of height cues present in the input audio for playback through the speaker system.

In some embodiments, the rendering includes rendering a first priority type of audio component in a first rendering processor, wherein the first rendering processor is optimized to render channel-based audio and static objects, and the rendering includes rendering a second priority type of audio component in a second rendering processor, wherein the second rendering processor is optimized to render the dynamic objects by at least one of an increased performance capability, an increased memory bandwidth, and an increased transmission bandwidth of the second rendering processor relative to the first rendering processor.

The first rendering processor and the second rendering processor may be implemented as separate rendering digital signal processors (DSPs) coupled to one another over a transmission link. The priority threshold value may be defined by one of: a preset value, a user selected value, and an automated process.

Embodiments are yet further directed to digital signal processing systems that implement the aforementioned methods and/or speaker systems that incorporate circuitry implementing at least some of the aforementioned methods, and/or computer readable storage mediums (e.g., non-transitory computer readable storage mediums) containing instructions that when executed by a processor perform methods described herein.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

FIG. 10 is a table illustrating some example metadata definitions for use in an adaptive audio system utilizing priority-based rendering for soundbars, under an embodiment.

DETAILED DESCRIPTION

Figure 1:
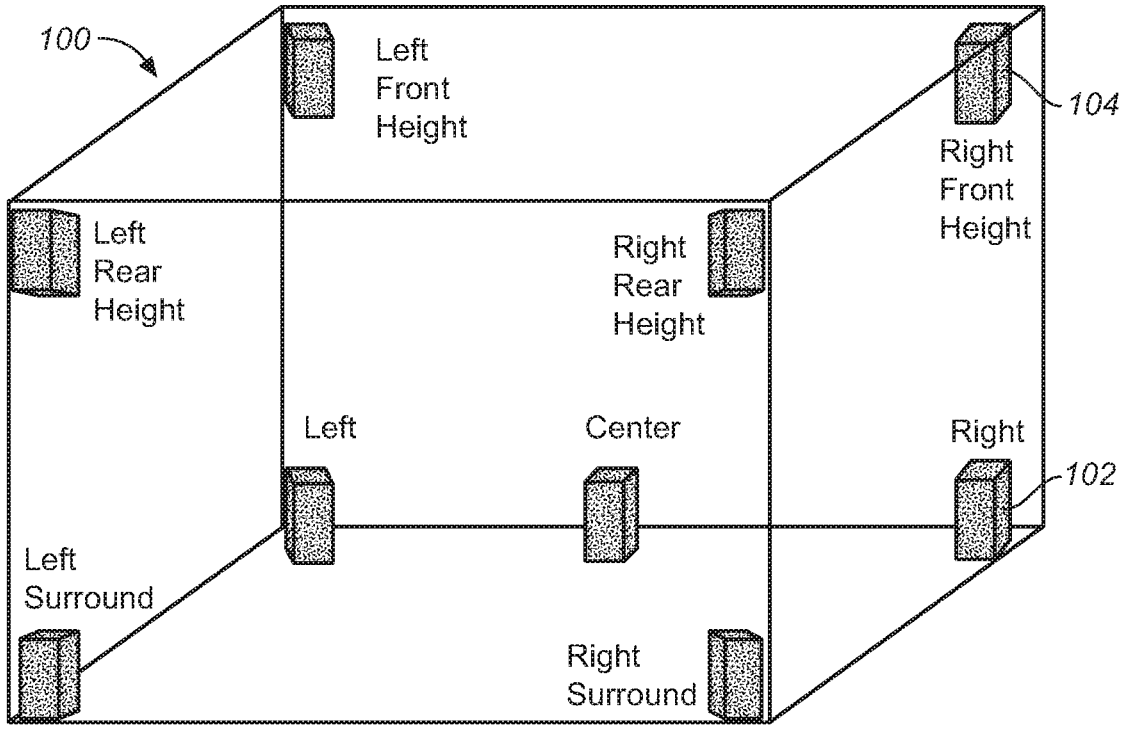
FIG. 1 illustrates an example speaker placement in a surround system (e.g., 9.1 surround) that provides height speakers for playback of height channels.

Systems and methods are described for a hybrid, priority-based rendering strategy where object audio metadata (OAMD) bed or intermediate spatial format (ISF) objects are rendered using a time-domain object audio renderer (OAR) component on a first DSP component, while OAMD dynamic objects are rendered by a virtual renderer in the post-processing chain on a second DSP component. The output audio may be optimized by one or more post-processing and virtualization techniques for playback through a soundbar speaker. Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; "adaptive audio" means channel-based and/or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content, and can be embodied in a home, cinema, theater, auditorium, studio, game console, and the like. Such an area may have one or more surfaces disposed therein, such as walls or baffles that can directly or diffusely reflect sound waves.

Adaptive Audio Format and System

In an embodiment, the interconnection system is implemented as part of an audio system that is configured to work with a sound format and processing system that may be referred to as a "spatial audio system" or "adaptive audio system." Such a system is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately.

An example implementation of an adaptive audio system and associated audio format is the Dolby® Atmos™ platform. Such a system incorporates a height (up/down) dimension that may be implemented as a 9.1 surround system, or similar surround sound configuration. FIG. 1 illustrates the speaker placement in a present surround system (e.g., 9.1 surround) that provides height speakers for playback of height channels. The speaker configuration of the 9.1 system 100 is composed of five speakers 102 in the floor plane and four speakers 104 in the height plane. In general, these speakers may be used to produce sound that is designed to emanate from any position more or less accurately within the room. Predefined speaker configurations, such as those shown in FIG. 1, can naturally limit the ability to accurately represent the position of a given sound source. For example, a sound source cannot be panned further left than the left speaker itself. This applies to every speaker, therefore forming a one-dimensional (e.g., left-right), two-dimensional (e.g., front-back), or three-dimensional (e.g., left-right, front-back, up-down) geometric shape, in which the downmix is constrained. Various different speaker configurations and types may be used in such a speaker configuration. For example, certain enhanced audio systems may use speakers in a 9.1, 11.1, 13.1, 19.4, or other configuration. The speaker types may include full range direct speakers, speaker arrays, surround speakers, subwoofers, tweeters, and other types of speakers.

Audio objects can be considered groups of sound elements that may be perceived to emanate from a particular physical location or locations in the listening environment. Such objects can be static (that is, stationary) or dynamic (that is, moving). Audio objects are controlled by metadata that defines the position of the sound at a given point in time, along with other functions. When objects are played back, they are rendered according to the positional metadata using the speakers that are present, rather than necessarily being output to a predefined physical channel A track in a session can be an audio object, and standard panning data is analogous to positional metadata. In this way, content placed on the screen might pan in effectively the same way as with channel-based content, but content placed in the surrounds can be rendered to an individual speaker if desired. While the use of audio objects provides the desired control for discrete effects, other aspects of a soundtrack may work effectively in a channel-based environment. For example, many ambient effects or reverberation actually benefit from being fed to arrays of speakers. Although these could be treated as objects with sufficient width to fill an array, it is beneficial to retain some channel-based functionality.

Figure 2:
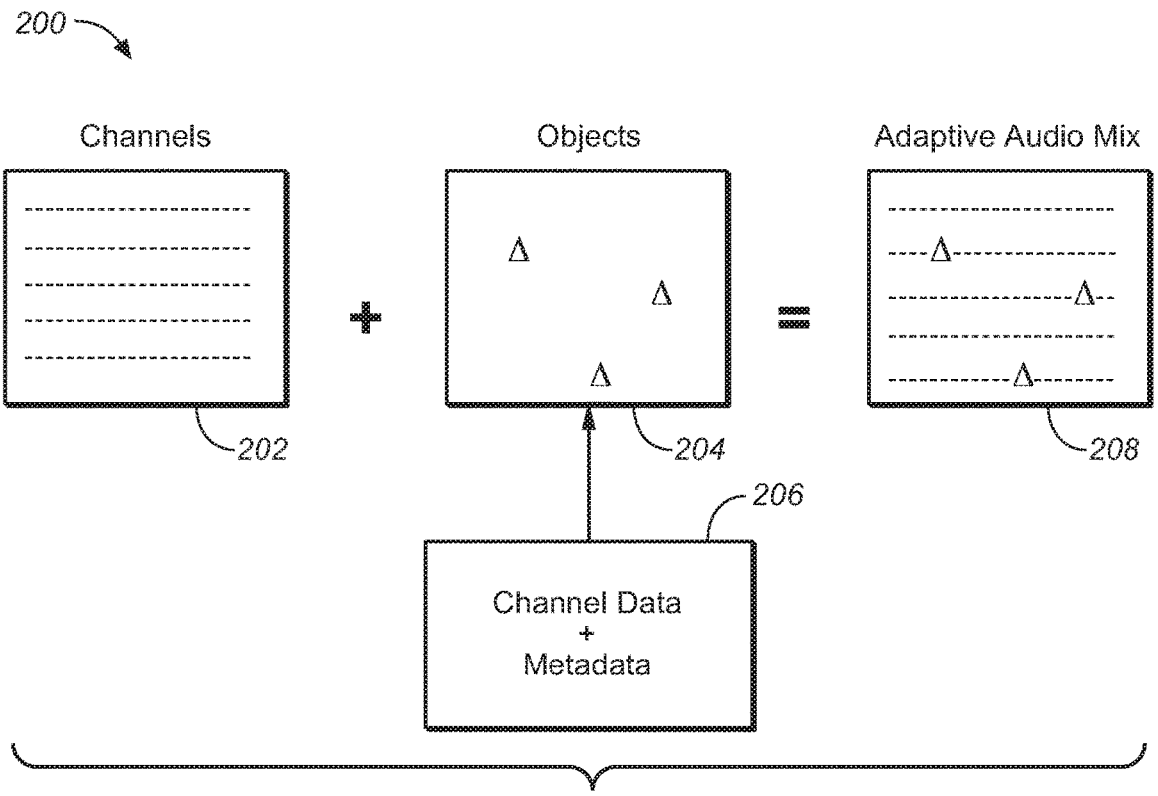
FIG. 2 illustrates the combination of channel and object-based data to produce an adaptive audio mix, under an embodiment.

The adaptive audio system is configured to support audio beds in addition to audio objects, where beds are effectively channel-based sub-mixes or stems. These can be delivered for final playback (rendering) either individually, or combined into a single bed, depending on the intent of the content creator. These beds can be created in different channel-based configurations such as 5.1, 7.1, and 9.1, and arrays that include overhead speakers, such as shown in FIG. 1. FIG. 2 illustrates the combination of channel and object-based data to produce an adaptive audio mix, under an embodiment. As shown in process 200, the channel-based data 202, which, for example, may be 5.1 or 7.1 surround sound data provided in the form of pulse-code modulated (PCM) data is combined with audio object data 204 to produce an adaptive audio mix 208. The audio object data 204 is produced by combining the elements of the original channel-based data with associated metadata that specifies certain parameters pertaining to the location of the audio objects. As shown conceptually in FIG. 2, the authoring tools provide the ability to create audio programs that contain a combination of speaker channel groups and object channels simultaneously. For example, an audio program could contain one or more speaker channels optionally organized into groups (or tracks, e.g., a stereo or 5.1 track), descriptive metadata for one or more speaker channels, one or more object channels, and descriptive metadata for one or more object channels.

Figure 3:
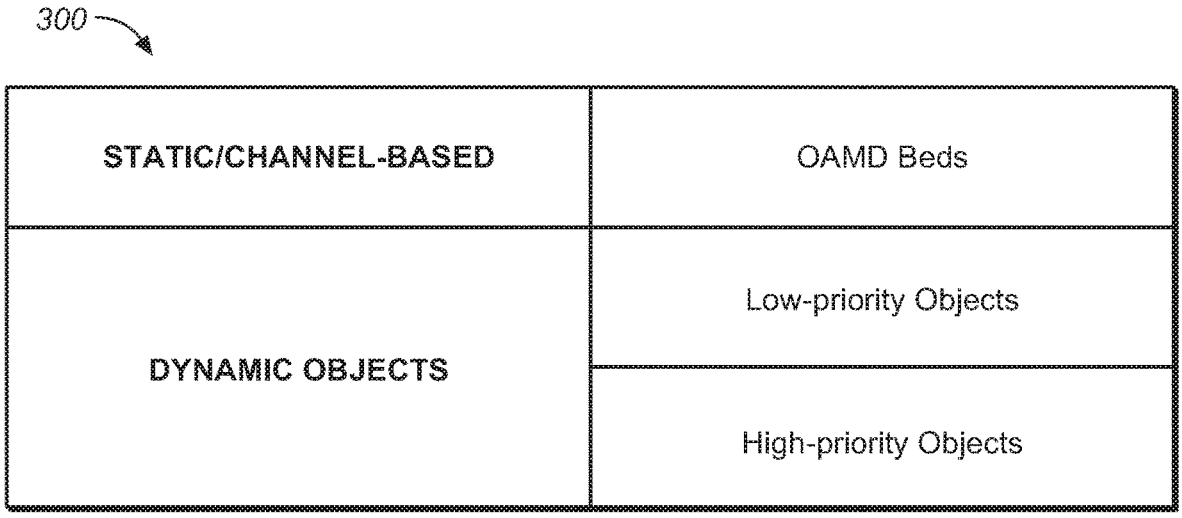
FIG. 3 is a table that illustrates the type of audio content that is processed in a hybrid, priority-based rendering system, under an embodiment.

In an embodiment, the bed and object audio components of FIG. 2 may comprise content that conforms to specific formatting standards. FIG. 3 is a table that illustrates the type of audio content that is processed in a hybrid, priority-based rendering system, under an embodiment. As shown in table 300 of FIG. 3, there are two main types of content, channel-based content that is relatively static with regard to trajectory and dynamic content that moves among the speakers or drivers in the system. The channel-based content may be embodied in OAMD beds, and the dynamic content are OAMD objects that are prioritized into at least two priority levels, low-priority and high-priority. The dynamic objects may be formatted in accordance with certain object formatting parameters and classified as certain types of objects, such as ISF objects. The ISF format is described in greater detail later in this description.

The priority of the dynamic objects reflects certain characteristics of the objects, such as content type (e.g., dialog versus effects versus ambient sound), processing requirements, memory requirements (e.g., high bandwidth versus low bandwidth), and other similar characteristics. In an embodiment, the priority of each object is defined along a scale and encoded in a priority field that is included as part of the bitstream encapsulating the audio object. The priority may be set as a scalar value, such as a 1 (lowest) to 10 (highest) integer value, or as a binary flag (0 low/1 high), or other similar encodable priority setting mechanism. The priority level is generally set once per object by the content author who may decide the priority of each object based on one or more of the characteristics mentioned above.

In an alternative embodiment, the priority level of at least some of the objects may be set by the user, or through an automated dynamic process that may modify a default priority level of an object based on certain run-time criteria such as dynamic processor load, object loudness, environmental changes, system faults, user preferences, acoustic tailoring, and so on.

Figure 4:
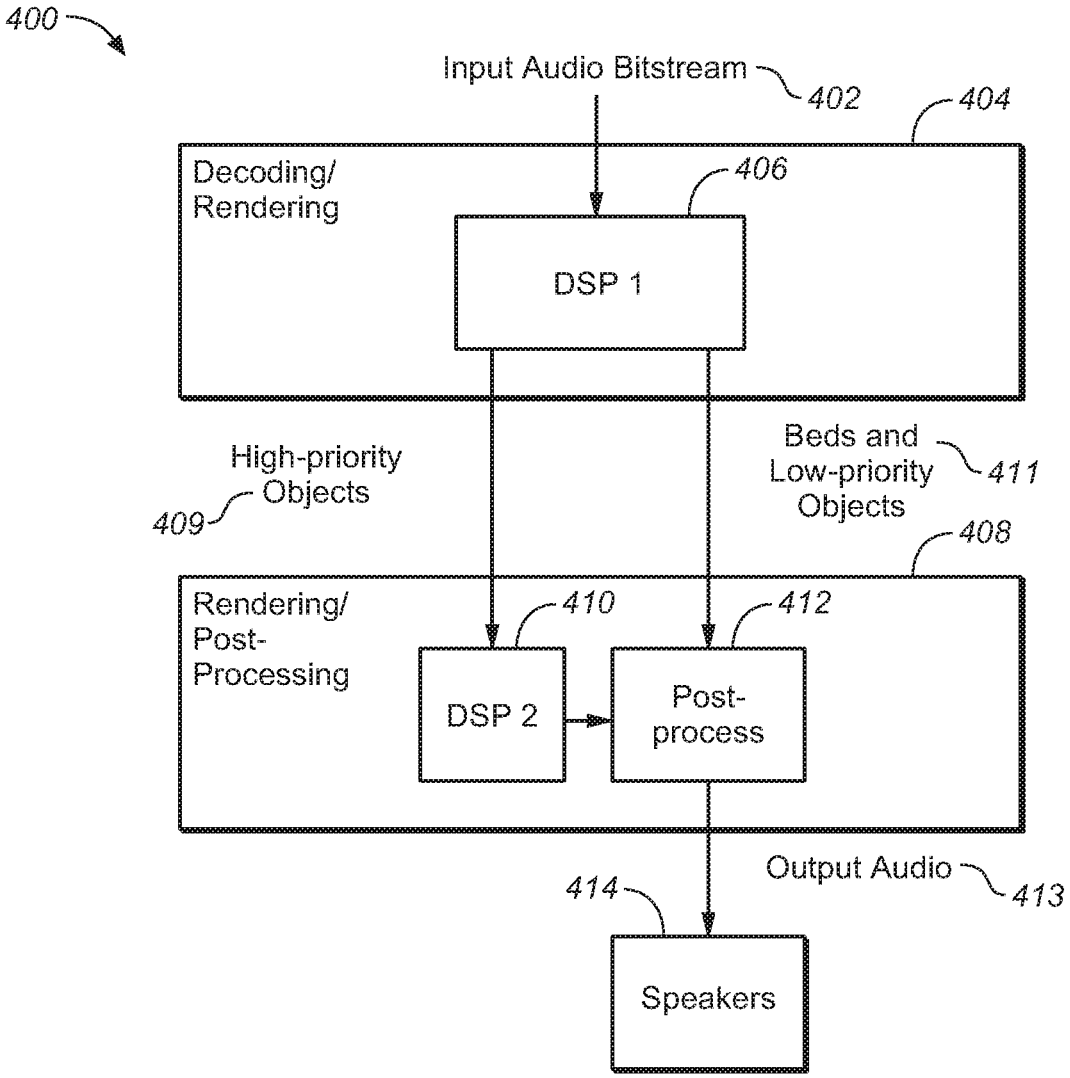
FIG. 4 is a block diagram of a multi-processor rendering system for implementing a hybrid, priority-based rendering strategy, under an embodiment.

In an embodiment, the priority level of the dynamic objects determines the processing of the object in a multi-processor rendering system. The encoded priority level of each object is decoded to determine which processor (DSP) of a dual or multi-DSP system will be used to render that particular object. This enables a priority-based rendering strategy to be used in rendering adaptive audio content. FIG. 4 is a block diagram of a multi-processor rendering system for implementing a hybrid, priority-based rendering strategy, under an embodiment. FIG. 4 shows a multi-processor rendering system 400 that includes two DSP components 406 and 410. The two DSPs are contained within two separate rendering subsystems, a decoding/rendering component 404 and a rendering/post-processing component 408. These rendering subsystems generally include processing blocks that perform legacy, object and channel audio decoding, objecting rendering, channel remapping and signal processing prior to the audio being sent to further post-processing and/or amplification and speaker stages.

System 400 is configured to render and playback audio content that is generated through one or more capture, pre-processing, authoring and coding components that encode the input audio as a digital bitstream 402. An adaptive audio component may be used to automatically generate appropriate metadata through analysis of input audio by examining factors such as source separation and content type. For example, positional metadata may be derived from a multi-channel recording through an analysis of the relative levels of correlated input between channel pairs. Detection of content type, such as speech or music, may be achieved, for example, by feature extraction and classification. Certain authoring tools allow the authoring of audio programs by optimizing the input and codification of the sound engineer's creative intent allowing him to create the final audio mix once that is optimized for playback in practically any playback environment. This can be accomplished through the use of audio objects and positional data that is associated and encoded with the original audio content. Once the adaptive audio content has been authored and coded in the appropriate codec devices, it is decoded and rendered for playback through speakers 414.

As shown in FIG. 4, object audio including object metadata and channel audio including channel metadata are input as an input audio bitstream to one or more decoder circuits within decoding/rendering subsystem 404. The input audio bitstream 402 contains data relating to the various audio components, such as those shown in FIG. 3, including OAMD beds, low-priority dynamic objects, and high-priority dynamic objects. The priority assigned to each audio object determines which of the two DSPs 406 or 410 performs the rendering process on that particular object. The OAMD beds and low-priority objects are rendered in DSP 406 (DSP 1), while the high-priority objects are passed through rendering subsystem 404 for rendering in DSP 410 (DSP 2). The rendered beds, low-priority objects, and high priority objects are then input to post-processing component 412 in subsystem 408 to generate output audio signal 413 that is transmitted for playback through speakers 414.

In an embodiment, the priority level differentiating the low-priority objects from the high-priority objects is set within a priority of the bitstream encoding the metadata for each associated object. The cut-off or threshold value between low and high-priority may be set as a value along the priority range, such as a value of 5 or 7 along a priority scale of 1 to 10, or a simple detector for a binary priority flag, 0 or 1. The priority level for each object may be decoded in a priority determination component within decoding subsystem 402 to route each object to the appropriate DSP (DSP1 or DSP2) for rendering.

The multi-processing architecture of FIG. 4 facilitates efficient processing of different types of adaptive audio bed and objects based on the specific configurations and capabilities of the DSPs, and the bandwidth/processing capacities of the network and processor components. In an embodiment, DSP1 is optimized to render OAMD beds and ISF objects, but may not be configured to optimally render OAMD dynamic objects, while DSP2 is optimized to render OAMD dynamic objects. For this application, the OAMD dynamic objects in the input audio are assigned high priority levels so that they are passed through to DSP2 for rendering, while the beds and ISF objects are rendered in DSP1. This allows the appropriate DSP to render the audio component or components that it is best able to render.

In addition to, or instead of the type of audio components being rendered (i.e., beds/ISF objects versus OAMD dynamic objects) the routing and distributed rendering of the audio components may be performed on the basis of certain performance related measures, such as the relative processing capabilities of the two DSPs and/or the bandwidth of the transmission network between the two DSPs. Thus, if one DSP is significantly more powerful than the other DSP, and the network bandwidth is sufficient to transmit the unrendered audio data, the priority level may be set so that the more powerful DSP is called upon to render more of the audio components. For example, if DSP2 is much more powerful than DSP1, it may be configured to render all of the OAMD dynamic objects, or all objects regardless of format, assuming it is capable of rendering these other types of objects.

In an embodiment, certain application-specific parameters, such as room configuration information, user-selections, processing/network constraints, and so on, may be fed-back to the object rendering system to allow the dynamic changing of object priority levels. The prioritized audio data is then processed through one or more signal processing stages, such as equalizers and limiters prior to output for playback through speakers 414.

It should be noted that system 400 represents an example of a playback system for adaptive audio, and other configurations, components, and interconnections are also possible. For example, two rendering DSPs are illustrated in FIG. 3 for processing dynamic objects differentiated into two types of priorities. An additional number of DSPs may also be included for greater processing power and more priority levels. Thus, N DSPs can be used for a number N of different priority distinctions, such as three DSPs for priority levels of high, medium, low, and so on.

In an embodiment, the DSPs 406 and 410 illustrated in FIG. 4 are implemented as separate devices coupled together by a physical transmission interface or network. The DSPs may be each contained within a separate component or subsystem, such as subsystems 404 and 408 as shown, or they may be separate components contained in the same subsystem, such as an integrated decoder/renderer component. Alternatively, the DSPs 406 and 410 may be separate processing components within a monolithic integrated circuit device.

Example Implementation

As mentioned above, the initial implementation of the adaptive audio format was in the digital cinema context that includes content capture (objects and channels) that are authored using novel authoring tools, packaged using an adaptive audio cinema encoder, and distributed using PCM or a proprietary lossless codec using the existing Digital Cinema Initiative (DCI) distribution mechanism. In this case, the audio content is intended to be decoded and rendered in a digital cinema to create an immersive spatial audio cinema experience. However, the imperative is now to deliver the enhanced user experience provided by the adaptive audio format directly to the consumer in their homes. This requires that certain characteristics of the format and system be adapted for use in more limited listening environments. For purposes of description, the term "consumer-based environment" is intended to include any non-cinema environment that comprises a listening environment for use by regular consumers or professionals, such as a house, studio, room, console area, auditorium, and the like.

Current authoring and distribution systems for consumer audio create and deliver audio that is intended for reproduction to pre-defined and fixed speaker locations with limited knowledge of the type of content conveyed in the audio essence (i.e., the actual audio that is played back by the consumer reproduction system). The adaptive audio system, however, provides a new hybrid approach to audio creation that includes the option for both fixed speaker location specific audio (left channel, right channel, etc.) and object-based audio elements that have generalized 3D spatial information including position, size and velocity. This hybrid approach provides a balanced approach for fidelity (provided by fixed speaker locations) and flexibility in rendering (generalized audio objects). This system also provides additional useful information about the audio content via new metadata that is paired with the audio essence by the content creator at the time of content creation/authoring. This information provides detailed information about the attributes of the audio that can be used during rendering. Such attributes may include content type (e.g., dialog, music, effect, Foley, background/ambience, etc.) as well as audio object information such as spatial attributes (e.g., 3D position, object size, velocity, etc.) and useful rendering information (e.g., snap to speaker location, channel weights, gain, bass management information, etc.). The audio content and reproduction intent metadata can either be manually created by the content creator or created through the use of automatic, media intelligence algorithms that can be run in the background during the authoring process and be reviewed by the content creator during a final quality control phase if desired.

Figure 5:
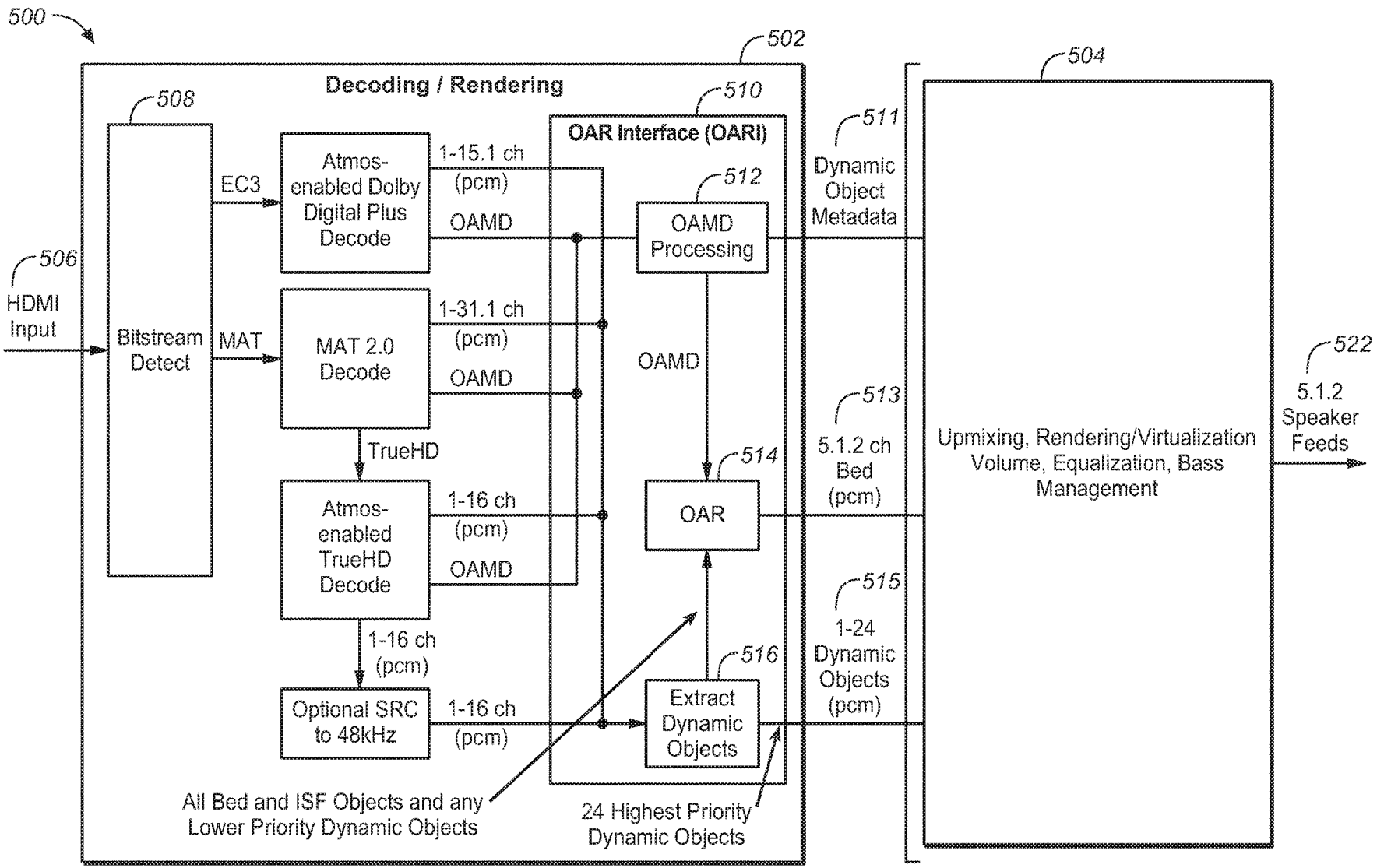
FIG. 5 is a more detailed block diagram of the multi-processor rendering system of FIG. 4, under an embodiment.

FIG. 5 is a block diagram of a priority-based rendering system for rendering different types of channel and object-based components, and is a more detailed illustration of the system illustrated in FIG. 4, under an embodiment. As shown in diagram FIG. 5, the system 500 processes an encoded bitstream 506 that carries both hybrid object stream (s) and channel-based audio stream(s). The bitstream is processed by rendering/signal processing blocks 502 and 504, which each represent or are implemented as separate DSP devices. The rendering functions performed in these processing blocks implement various rendering algorithms for adaptive audio, as well as certain post-processing algorithms, such as upmixing, and so on.

The priority-based rendering system 500 comprises the two main components of decoding/rendering stage 502 and rendering/post-processing stage 504. The input audio 506 is provided to the decoding/rendering stage through an HDMI (high-definition multimedia interface), though other interfaces are also possible. A bitstream detection component 508 parses the bitstream and directs the different audio components to the appropriate decoders, such as a Dolby Digital Plus decoder, MAT 2.0 decoder, TrueHD decoder, and so on. The decoders generate various formatted audio signals, as OAMD bed signals and ISF or OAMD dynamic objects.

The decoding/rendering stage 502 includes an OAR (object audio renderer) interface 510 that includes an OAMD processing component 512, an OAR component 514 and a dynamic object extraction component 516. The dynamic extraction unit 516 takes the output from all of the decoders and separates out the bed and ISF objects, along with any low-priority dynamic objects from the high priority dynamic objects. The bed, ISF objects, and low-priority dynamic objects are sent to the OAR component 514. For the example embodiment shown, the OAR component 514 represents the core of a processor (e.g., DSP) circuit 502 and renders to a fixed 5.1.2-channel output format (e.g. standard 5.1+2 height channels) though other surround-sound plus height configurations are also possible, such as 7.1.4, and so on. The rendered output 513 from OAR component 514 is then transmitted to a digital audio processor (DAP) component of the rendering/post-processing stage 504. This stage performs functions such as upmixing, rendering/virtualization, volume control, equalization, bass management, and other possible functions. The output 522 from stage 504 comprises 5.1.2 speaker feeds, in an example embodiment. Stage 504 may be implemented as any appropriate processing circuit, such as a processor, DSP, or similar device.

In an embodiment, the output signals 522 are transmitted to a soundbar or soundbar array. For a specific use case example, such as illustrated in FIG. 5, the soundbar also employs a priority-based rendering strategy to support the use-case of MAT 2.0 input with 31.1 objects, while not eclipsing the memory bandwidth between the two stages 502 and 504. In an example implementation, the memory bandwidth allows for a maximum of 32 audio channels at 48 kHz to be read or written from external memory. Since 8 channels are required for the 5.1.2-channel rendered output 513 of the OAR component 514, a maximum of 24 OAMD dynamic objects may be rendered by a virtual renderer in the post-processing chain 504. If more than 24 OAMD dynamic objects are present in the input stream 506, the additional lowest-priority objects must be rendered by the OAR component 514 on the first stage 502. The priority of dynamic objects is determined based on their position in the OAMD stream (e.g., highest priority objects first, lowest priority objects last).

Although the embodiments of FIGS. 4 and 5 are described in relation to beds and objects that conform to OAMD and ISF formats, it should be understood that the priority-based rendering scheme using a multi-processor rendering system can be used with any type of adaptive audio content comprising channel-based audio and two or more types of audio objects, wherein the object types can be distinguished on the basis of relative priority levels. The appropriate rendering processors (e.g., DSPs) may be configured to optimally render all or only one type of audio object type and/or channel-based audio component.

Figure 6:
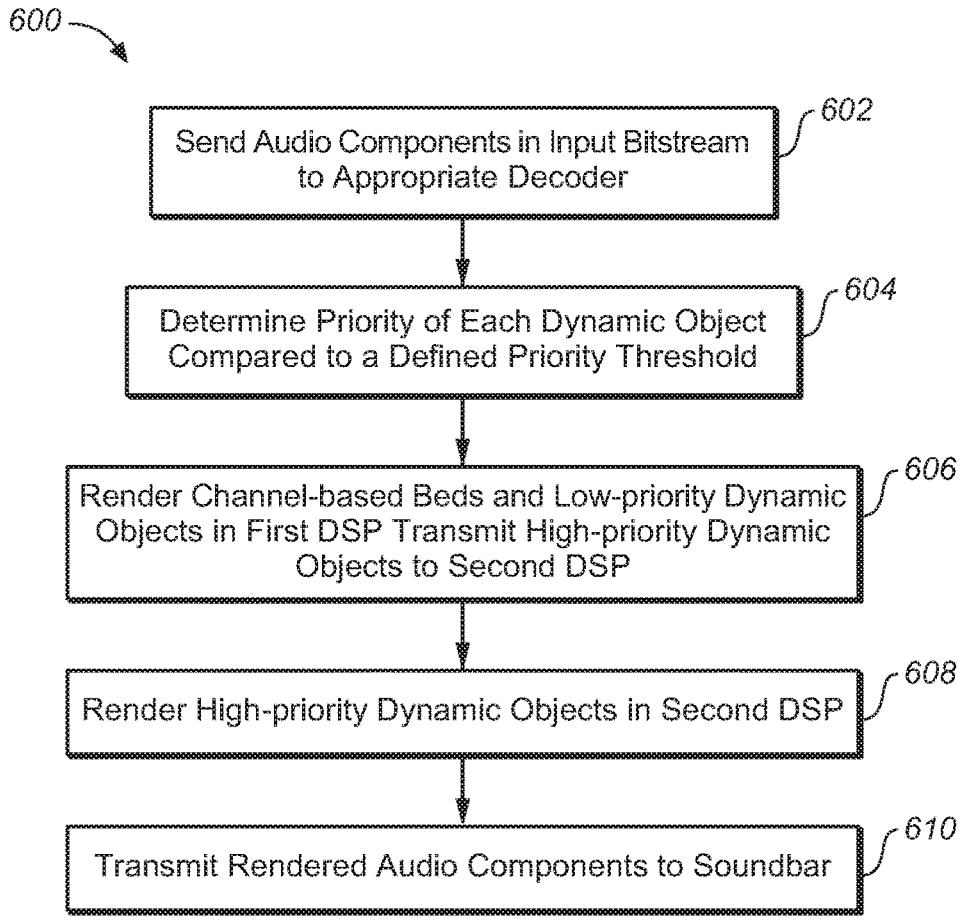
FIG. 6 is a flowchart that illustrates a method of implementing priority-based rendering for playback of adaptive audio content through a soundbar, under an embodiment.

System 500 of FIG. 5 illustrates a rendering system that adapts the OAMD audio format to work with specific rendering applications involving channel-based beds, ISF objects, and OAMD dynamic objects, as well as rendering for playback through soundbars. The system implements a priority-based rendering strategy that addresses certain implementation complexity issues with recreating adaptive audio content through soundbars or similar collocated speaker systems. FIG. 6 is a flowchart that illustrates a method of implementing priority-based rendering for playback of adaptive audio content through a soundbar, under an embodiment. Process 600 of FIG. 6 generally represents method steps performed in the priority-based rendering system 500 of FIG. 5. After receiving an input audio bitstream, the audio components comprising channel-based beds and audio objects of different formats are input to appropriate decoder circuits for decoding, 602. The audio objects include dynamic objects that may be formatted using different format schemes, and may be differentiated based upon a relative priority that is encoded with each object, 604. The process determines the priority level of each dynamic audio object as compared to a defined priority threshold by reading the appropriate metadata field within the bitstream for the object. The priority threshold differentiating low-priority objects from high-priority objects may be programmed into the system as a content creator set hardwired value, or it may be dynamically set by user input, automated means, or other adaptive mechanism. The channel-based beds and low priority dynamic objects, along with any objects that are optimized to be rendered in a first DSP of the system are then rendered in that first DSP, 606. The high-priority dynamic objects are passed along to a second DSP, where they are then rendered, 608. The rendered audio components are then transmitted through certain optional post-processing steps for playback through a soundbar or soundbar array, 610.

Soundbar Implementation

Figure 7:
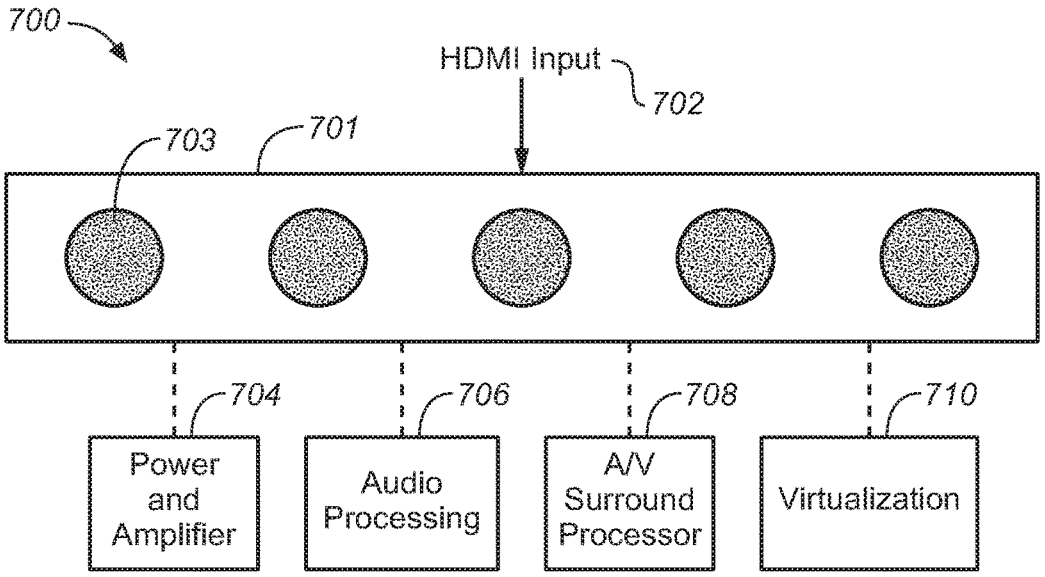
FIG. 7 illustrates a soundbar speaker that may be used with embodiments of a hybrid, priority-based rendering system.

As shown in FIG. 4, the prioritized and rendered audio output produced by the two DSPs is transmitted to a soundbar for playback to the user. Soundbar speakers have become increasingly popular given the prevalence of flat screen televisions. Such televisions are becoming very thin and relatively light to optimize portability and mounting options despite offering ever increasing screen sizes at affordable prices. The sound quality of these televisions, however, is often very poor given the space, power, and cost-constraints. Soundbars are often stylish, powered speakers that are placed below a flat panel television to improve the quality of the television audio and can be used on their own or as part of a surround-sound speaker setup. FIG. 7 illustrates a soundbar speaker that may be used with embodiments of a hybrid, priority-based rendering system. As shown in system 700, a soundbar speaker comprises a cabinet 701 that houses a number of drivers 703 that are arrayed along a horizontal (or vertical) axis to drive sound directly out of the front plane of the cabinet. Any practical number of drivers 701 may be used depending on size and system constraints, and typical numbers range from 2-6 drivers. The drivers may be of the same size and shape or they may be arrays of different drivers, such as a larger central driver for lower frequency sound. An HDMI input interface 702 may be provided to allow direct interface to high definition audio systems.

The soundbar system 700 may be a passive speaker system with no on-board power or amplification and minimal passive circuitry. It may also be a powered system with one or more components installed within the cabinet, or closely coupled through external components. Such functions and components include power supply and amplification 704, audio processing (e.g., EQ, bass control, etc.) 706, A/V surround sound processor 708, and adaptive audio virtualization 710. For purposes of description, the term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure.

Figure 8:
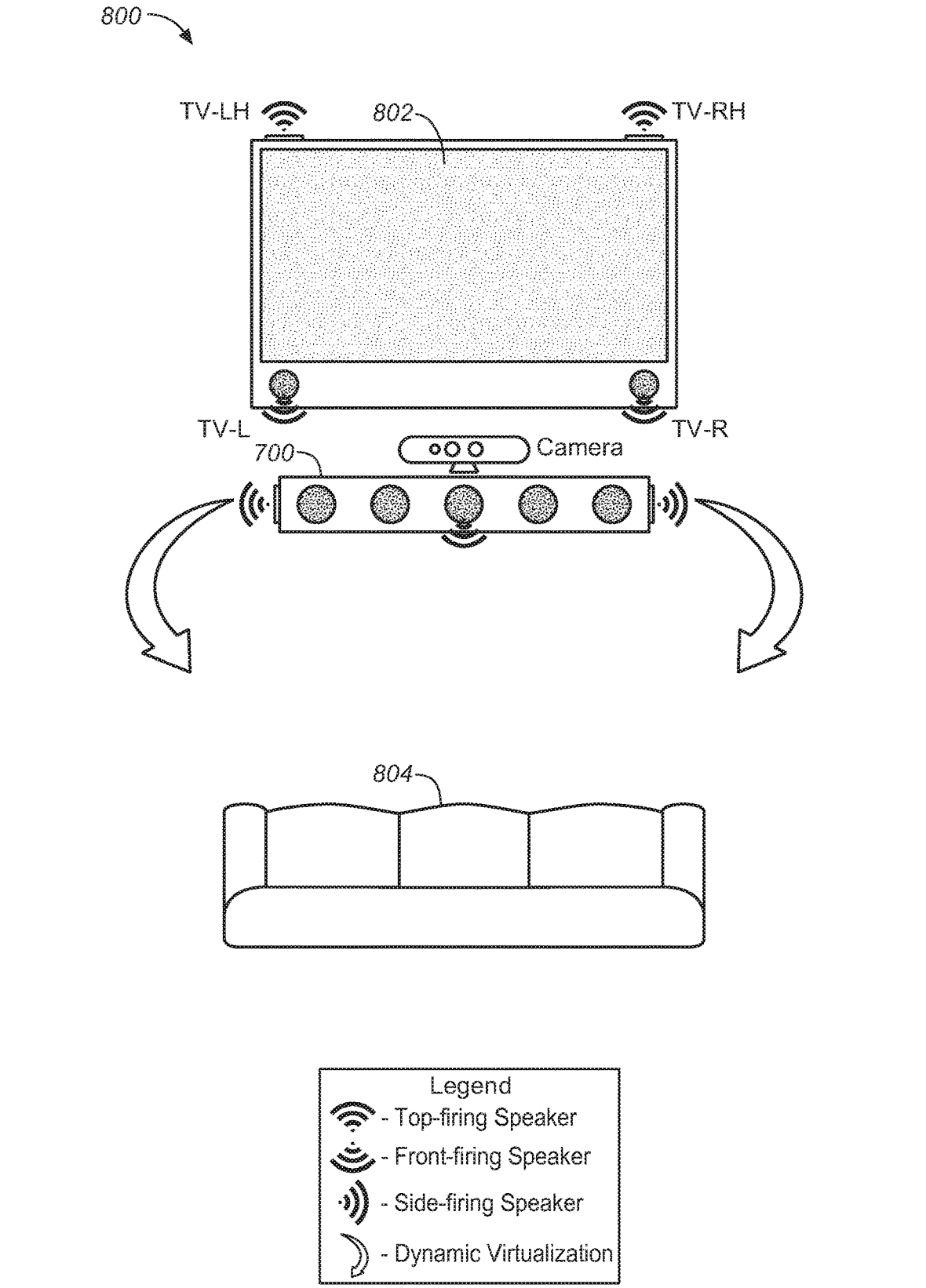
FIG. 8 illustrates the use of a priority-based adaptive audio rendering system in an example television and soundbar consumer use case.

The virtualization function provided in component 710 for soundbar 710, or as a component of the rendering processor 504 allows the implementation of an adaptive audio system in localized applications, such as televisions, computers, game consoles, or similar devices, and allows the spatial playback of this audio through speakers that are arrayed in a flat plane corresponding to the viewing screen or monitor surface. FIG. 8 illustrates the use of a priority-based adaptive audio rendering system in an example television and soundbar consumer use case. In general, the television use case provides challenges to creating an immersive consumer experience based on the often reduced quality of equipment (TV speakers, soundbar speakers, etc.) and speaker locations/configuration(s), which may be limited in terms of spatial resolution (i.e. no surround or back speakers). System 800 of FIG. 8 includes speakers in the standard television left and right locations (TV-L and TV-R) as well as possible optional left and right upward-firing drivers (TV-LH and TV-RH). The system also includes a soundbar 700 as shown in FIG. 7. As stated previously, the size and quality of television speakers are reduced due to cost constraints and design choices as compared to stand-alone or home theater speakers. The use of dynamic virtualization in conjunction with soundbar 700, however, can help to overcome these deficiencies. The soundbar 700 of FIG. 8 is illustrated as having forward firing drivers as well as possible side-firing drivers, all arrayed along the horizontal axis of the soundbar cabinet. In FIG. 8, the dynamic virtualization effect is illustrated for the soundbar speakers so that people in a specific listening position 804 would hear horizontal elements associated with appropriate audio objects individually rendered in the horizontal plane. The height elements associated with appropriate audio objects may be rendered through the dynamic control of the speaker virtualization algorithms parameters based on object spatial information provided by the adaptive audio content in order to provide at least a partially immersive user experience. For the collocated speakers of the soundbar, this dynamic virtualization may be used for creating the perception of objects moving along the sides on the room, or other horizontal planar sound trajectory effects. This allows the soundbar to provide spatial cues that would otherwise be absent due to the lack of surround or back speakers.

In an embodiment, the soundbar 700 may include non-collocated drivers, such as upward firing drivers that utilize sound reflection to allow virtualization algorithms that provide height cues. Certain of the drivers may be configured to radiate sound in different directions to the other drivers, for example one or more drivers may implement a steerable sound beam with separately controlled sound zones.

Figure 9:
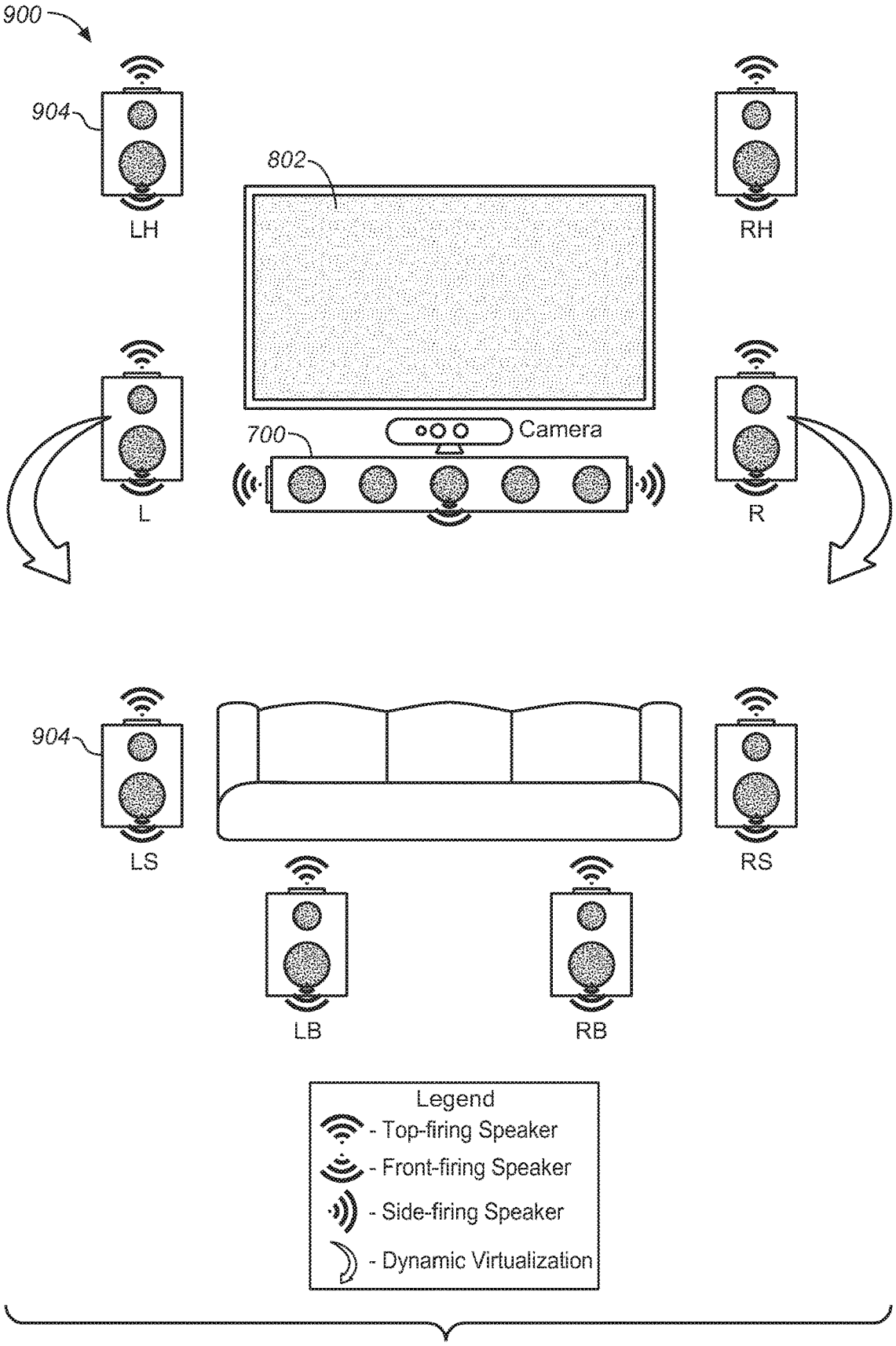
FIG. 9 illustrates the use of a priority-based adaptive audio rendering system in an example full surround-sound home environment.

In an embodiment, the soundbar 700 may be used as part of a full surround sound system with height speakers, or height-enabled floor mounted speakers. Such an implementation would allow the soundbar virtualization to augment the immersive sound provided by the surround speaker array. FIG. 9 illustrates the use of a priority-based adaptive audio rendering system in an example full surround-sound home environment. As shown in system 900, soundbar 700 associated with television or monitor 802 is used in conjunction with a surround-sound array of speakers 904, such as in the 5.1.2 configuration shown. For this case, the soundbar 700 may include an A/V surround sound processor 708 to drive the surround speakers and provide at least part of the rendering and virtualization processes. The system of FIG. 9 illustrates just one possible set of components and functions that may be provided by an adaptive audio system, and certain aspects may be reduced or removed based on the user's needs, while still providing an enhanced experience.

FIG. 9 illustrates the use of dynamic speaker virtualization to provide an immersive user experience in the listening environment in addition to that provided by the soundbar. A separate virtualizer may be used for each relevant object and the combined signal can be sent to the L and R speakers to create a multiple object virtualization effect. As an example, the dynamic virtualization effects are shown for the L and R speakers. These speakers, along with audio object size and position information, could be used to create either a diffuse or point source near field audio experience. Similar virtualization effects can also be applied to any or all of the other speakers in the system.

In an embodiment, the adaptive audio system includes components that generate metadata from the original spatial audio format. The methods and components of system 500 comprise an audio rendering system configured to process one or more bitstreams containing both conventional channel-based audio elements and audio object coding elements.

A new extension layer containing the audio object coding elements is defined and added to either one of the channel-based audio codec bitstream or the audio object bitstream. This approach enables bitstreams, which include the extension layer to be processed by renderers for use with existing speaker and driver designs or next generation speakers utilizing individually addressable drivers and driver definitions. The spatial audio content from the spatial audio processor comprises audio objects, channels, and position metadata. When an object is rendered, it is assigned to one or more drivers of a soundbar or soundbar array according to the position metadata, and the location of the playback speakers. Metadata is generated in the audio workstation in response to the engineer's mixing inputs to provide rendering queues that control spatial parameters (e.g., position, velocity, intensity, timbre, etc.) and specify which driver(s) or speaker(s) in the listening environment play respective sounds during exhibition. The metadata is associated with the respective audio data in the workstation for packaging and transport by spatial audio processor. FIG. 10 is a table illustrating some example metadata definitions for use in an adaptive audio system utilizing priority-based rendering for soundbars, under an embodiment. As shown in table 1000 of FIG. 10, some of the metadata may include elements that define the audio content type (e.g., dialogue, music, etc.) and certain audio characteristics (e.g., direct, diffuse, etc.). For the priority-based rendering system that plays through a soundbar, the driver definitions included in the metadata may include configuration information of the playback soundbar (e.g., driver types, sizes, power, built-in A/V, virtualization, etc.), and other speakers that may be used with the soundbar (e.g., other surround speakers, or virtualization-enabled speakers). With reference to FIG. 5, the metadata may also include fields and data that define the decoder type (e.g., Digital Plus, TrueHD, etc.) from which can be derived the specific format of the channel-based audio and dynamic objects (e.g., OAMD beds, ISF objects, dynamic OAMD objects, etc.). Alternatively, the format of each object may be explicitly defined through specific associated metadata elements. The metadata also includes a priority field for the dynamic objects, and the associated metadata may be expressed as a scalar value (e.g., 1 to 10) or a binary priority flag (high/low). The metadata elements illustrated in FIG. 10 are meant to be illustrative of only some of the possible metadata elements encoded in the bitstream transmitting the adaptive audio signal, and many other metadata elements and formats are also possible.

Intermediate Spatial Format

Figure 11:
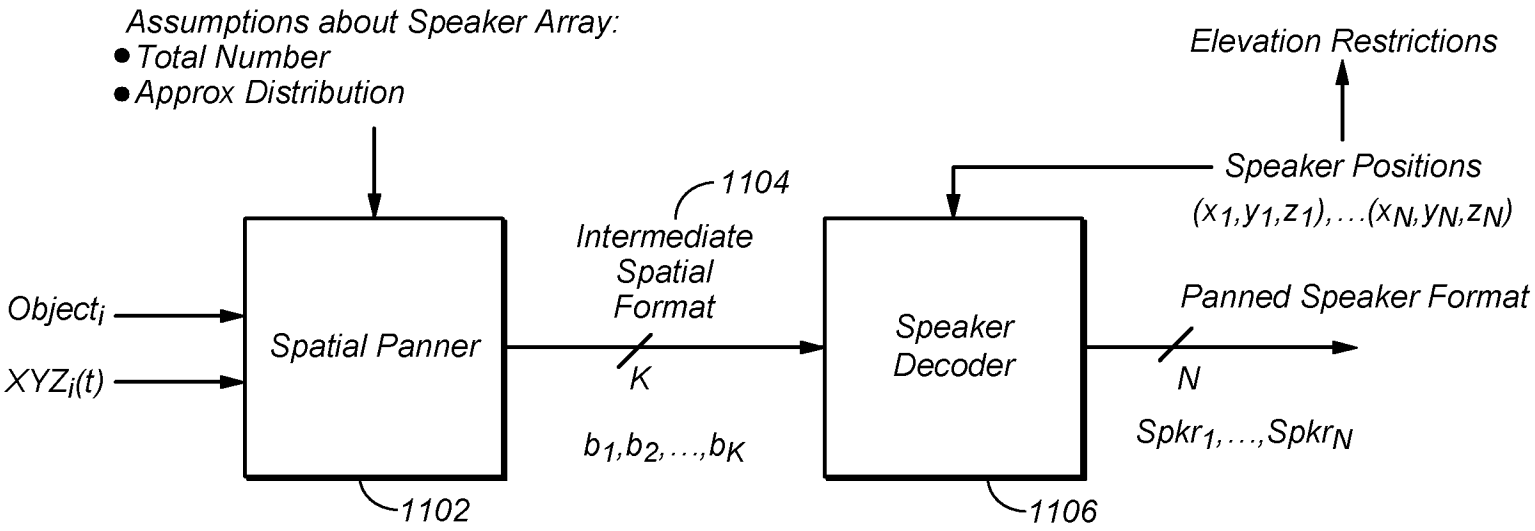
FIG. 11 illustrates in Intermediate Spatial Format for use with a rendering system, under some embodiments.

As described above for one or more embodiments, certain objects processed by the system are ISF objects. ISF is a format that optimizes the operation of audio object panners by splitting the panning operation into two parts: a time-varying part and a static part. In general, an audio object panner operates by panning a monophonic object (e.g. $Object_i$) to N speakers, whereby the panning gains are determined as a function of the speaker locations, $(x_1, y_1, z_1), \ldots, (x_N, y_N, z_N)$, and the object location, $XYZ_i(t)$. These gain values will be varying continuously over time, because the object location will be time varying. The goal of an Intermediate Spatial Format is simply to split this panning operation into two parts. The first part (which will be time-varying) makes use of the object location. The second part (which uses a fixed matrix) will be configured based on only the speaker locations. FIG. 11 illustrates an Intermediate Spatial Format for use with a rendering system, under some embodiments. As shown in diagram 1100, spatial panner 1102 receives the object and speaker location information for decondign by speaker decoder 1106. In between these two processing blocks 1102 and 1106, the audio object scene is represented in K-channel Intermediate Spatial Format (ISF) 1104. Multiple audio objects $(1 \Leftarrow i \Leftarrow N_i)$ may be processed by individual spatial panners with the outputs of the Spatial Panners being summed together to form ISF signal 1104, so that one K-channel ISF signal set may contain a superposition of $N_i$ objects. In certain embodiments, the encoder may also be given information regarding speaker heights through elevation restriction data so that detailed knowledge of the elevations of the playback speakers may be used by the spatial panner 1102.

In an embodiment, the spatial panner 1102 is not given detailed information about the location of the playback speakers. However, an assumption is made of the location of a series of 'virtual speakers' which are restricted to a number of levels or layers and approximate distribution within each level or layer. Thus, while the Spatial Panner is not given detailed information about the location of the playback speakers, there will often be some reasonable assumptions that can be made regarding the likely number of speakers, and the likely distribution of those speakers.

Figure 12:
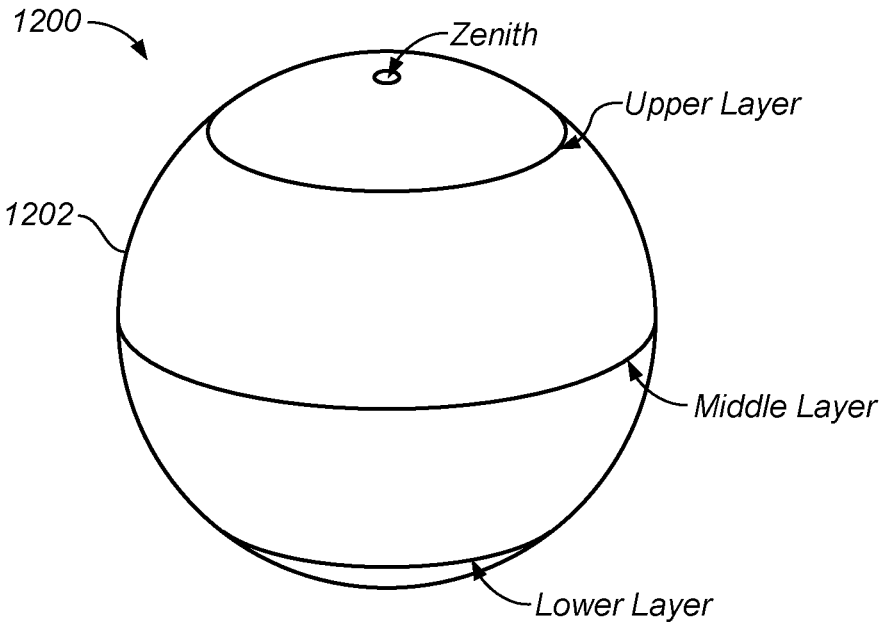
FIG. 12 illustrates an arrangement of rings in a stacked-ring format panning space for use with an Intermediate Spatial Format, under an embodiment.

The quality of the resulting playback experience (i.e. how closely it matches the audio object panner of FIG. 11) can be improved by either increasing the number of channels, K, in the ISF, or by gathering more knowledge about the most probable playback speaker placements. In particular, in an embodiment, the speaker elevations are divided into a number of planes, as shown in FIG. 12. A desired composed soundfield can be considered as a series of sonic events emanating from arbitrary directions around a listener. The location of the sonic events can be considered to be defined on the surface of a sphere 1202 with the listener at the center. A soundfield format (such as Higher Order Ambisonics) is defined in such a way to allow the soundfield to be further rendered over (fairly) arbitrary speaker arrays. However, typical playback systems envisaged are likely to be constrained in the sense that the elevations of speakers are fixed in 3 planes (an ear-height plane, a ceiling plane, and a floor plane). Hence, the notion of the ideal spherical soundfield can be modified, where the soundfield is composed of sonic objects that are located in rings at various heights on the surface of a sphere around the listener. For example, one such arrangement of rings is illustrated 1200 in FIG. 12, with a zenith ring, an upper layer ring, middle layer ring and lower ring. If necessary, for the purpose of completeness, an additional ring at the bottom of the sphere can also be included (the Nadir, which is also a point, not a ring, strictly speaking). Moreover, additional or fewer numbers of rings may be present in other embodiments.

In an embodiment, a stacked-ring format is named as BH9.5.0.1, where the four numbers indicate the number channels in the Middle, Upper, Lower and Zenith rings respectively. The total number of channels in the multi-channel bundle will be equal to the sum of these four numbers (so the BH9.5.0.1 format contains 15 channels). Another example format, which makes use of all four rings, is BH15.9.5.1. For this format, the channel naming and ordering will be as follows: [M1, M2, M15, U1, U2 . . . U9, L1, L2, L5, Z1], where the channels are arranged in rings (in M, U, L, Z order), and within each ring they are simply numbered in ascending cardinal order. Each ring can be thought of as being populated by a set of nominal speaker channels that are uniformly spread around the ring. Hence, the channels in each ring will correspond to specific decoding angles, starting with channel 1, which will correspond to the 0° azimuth (directly in front) and enumerating in anticlockwise order (so channel 2 will be to the left of center, from the listener's viewpoint). Hence, the azimuth angle of channel n will be $$\frac{n-1}{N} \times 360^{\circ}$$

(where N is the number of channels in that ring, and n is in the range from 1 to N).

With regards to certain use-cases for object_priority as related to ISF, OAMD generally allows each ring in ISF to have individual object_priority values. In an embodiment, these priority values are used in multiple ways to perform additional processing. First, height and lower plane rings are rendered by a minimal/sub-optimal renderer while important listener plane rings can be rendered by a more complex/precision high-quality renderer. Similarly, in an encoded format, more bits (i.e. higher quality encoding) can be used for listener plane rings and fewer bits for height and ground plane rings. This is possible in ISF because it uses rings, whereas this is not generally possible in traditional higher-order Ambisonics formats since each distinct channel is a polar-pattern that interact in a way that would compromise overall audio quality. In general, a slightly reduced rendering quality for height or floor rings is not overly detrimental since content in those rings typically only contain atmospheric content.

In an embodiment, the rendering and sound processing system uses two or more rings to encode a spatial audio scene, wherein different rings represent different spatially separate components of the soundfield. The audio objects are panned within a ring according the repurposable panning curves, and audio objects are panned between rings using non-repurposable panning curves. Different spatially separate components are separated on the basis of their vertical axis (i.e., as vertically stacked rings). Soundfield elements are transmitted within each ring, in the form of 'nominal speakers': and soundfield elements within each ring are transmitted in the form of spatial frequency components. Decoding matrices are generated for each ring by stitching together precomputed sub-matrices that represent segments of the ring. Sound from one ring to another ring can be redirected if speakers are not present in the first ring.

In an ISF processing system, the location of each speaker in the playback array can be expressed in terms of (x, y, z) coordinates (this is the location of each speaker relative to a candidate listening position that is close to the center of the array). Furthermore, the (x, y, z) vector can be converted into a unit-vector, to effectively project each speaker location onto the surface of a unit-sphere:

$$Speakerlocation: V_n = \begin{bmatrix} x_n \\ y_n \\ z_n \end{bmatrix} \{1 \le n \le N\} \tag{1}$$

$$Speakerunitvector: U_n = \frac{1}{\sqrt{V_n^T \times V_n}} \times V_n \tag{2}$$

Figure 13:
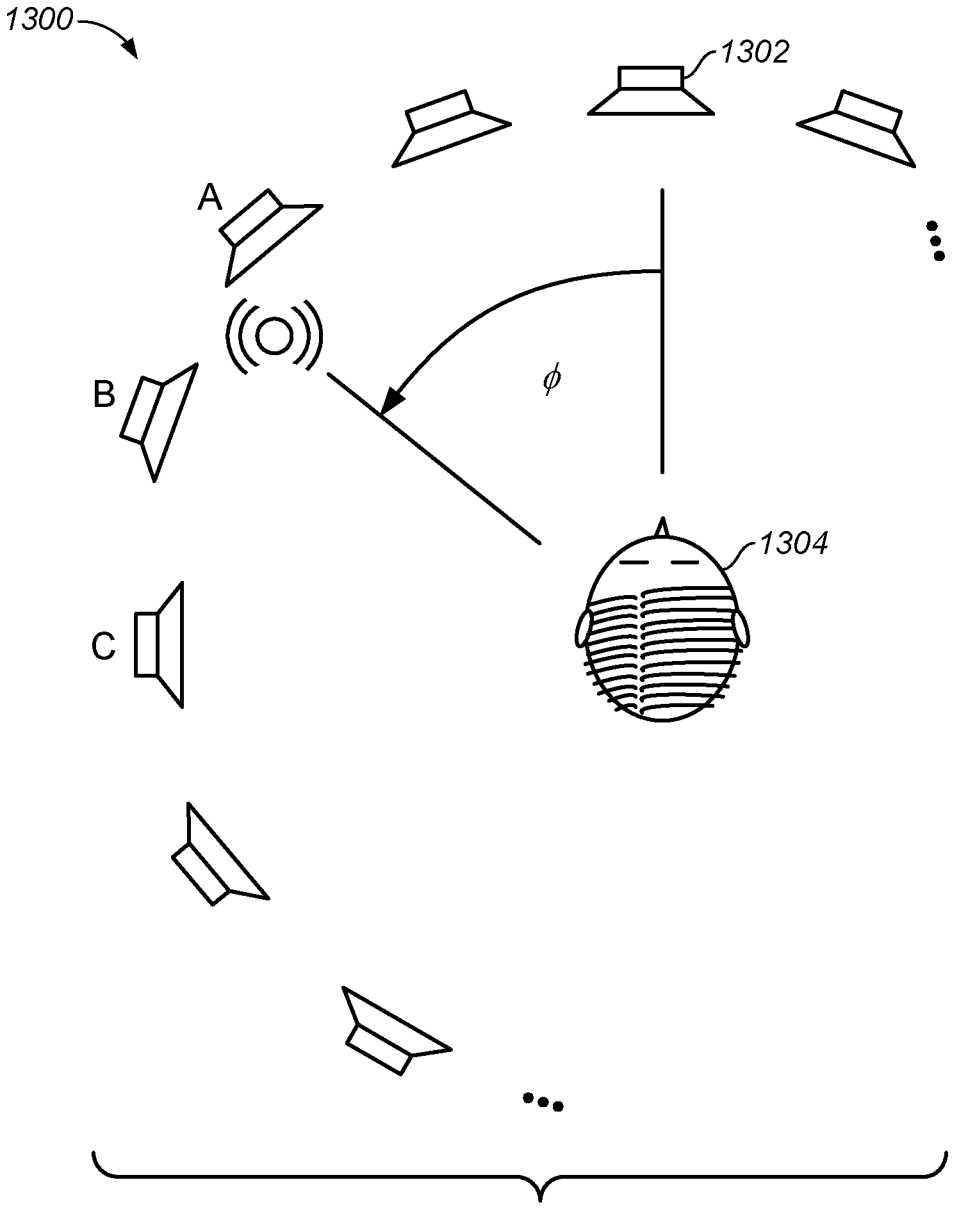
FIG. 13 illustrates an arc of speakers with an audio object panned to an angle for use in an ISF processing system, under an embodiment.

FIG. 13 illustrates an arc of speakers with an audio object panned to an angle for use in an ISF processing system, under an embodiment. Diagram 1300 illustrates a scenario where an audio object (o) is panned sequentially through a number of speakers 1302 so that a listener 1304 experiences the illusion of an audio object that is moving through a trajectory that passes through each speaker in sequence). Without loss of generality, assume that the unit-vectors of these speakers 1302 are arranged along a ring in the horizontal plane, so that the location of the audio object may be defined as a function of its azimuth angle, $\phi$. In FIG. 13, the audio object at angle $\phi$ passes through speakers A, B and C (where these speakers are located at azimuth angles $\phi_A$, $\phi_B$ and $\phi_C$ respectively). An audio object panner (e.g., panner 1102 in FIG. 11) will typically pan an audio object to each speaker using a speaker-gain that is a function of the angle, $\phi$. The audio object panner may use panning curves that have the following properties: (1) when an audio object is panned to a position that coincides with a physical speaker location, the coincident speaker is used to the exclusion of all other speakers; (2) when an audio-object is panned to angle $\phi$, that lies between two speaker locations, only those two speakers are active, thus providing for a minimal amount of 'spreading' of the audio signal over the speaker array; (3) the panning curves may exhibit a high level of 'discreteness' referring to the fraction of the panning curve energy that is constrained in the region between one speaker and it's nearest neighbours. Thus, with referen to FIG. 13, for speaker B:

$$\text{Discreteness: } d_B = \frac{\int_{\phi_A}^{\phi_C} gain_B(\phi)^2 d\phi}{\int_0^{2\pi} gain_B(\phi)^2 d\phi} \tag{3}$$

Hence, $d_B \le 1$ and when $d_B = 1$, this implies that the panning curve for speaker B is entirely constrained (spatially) to be non-zero only in the region between $\phi_A$ and $\phi_C$ (the angular positions of speakers A and C, respectively). In contrast, panning curves that do not exhibit the 'discreteness' properties described above (i.e. $d_B < 1$), may exhibit one ther important property: the panning curves are spatially smoothed, so that they are constrained in spatial frequency, so as to satisfy the Nyquist sampling theorem.

Any panning curve that is spatially band-limited cannot be compact in its spatial support. In other words, these panning curves will spread over a wider angular range. The term 'stop-band-ripple' refers to the (undesirable) non-zero gain that occurs in the panning curves. By satisfying the Nyquist sampling criterion, these panning curves suffer from being less 'discrete.' Being properly 'Nyquist-sampled', these panning curves can be shifted to alternative speaker locations. This means that a set of speaker signals that have been created for a particular arrangement of N speakers (that are evenly spaced in a circle) can be remixed (by an N×N matrix) to an alternative set of N speakers at different angular locations; that is, the speaker array can be rotated to a new set of angular speaker locations, and the original N speaker signals can be repurposed to the new set of N speakers. In general, this 're-purposability' property allows the system to remap N speaker signals, through an S×N matrix, to S speakers, provided it is acceptable that, for the case where S>N, the new speaker feeds will not be any more 'discrete' that the original N channels.

In an embodiment, the Stacked-Ring Intermediate Spatial Format represents each object, according to its (time varying) (x, y, z) location, by the following steps:

1. Object i is located at $(x_i, y_i, z_i)$ and this location is assumed to lie within a cube (so $|x_i| \le 1$, $|y_i| \le 1$ and $-|z_i| \le 1$), or within a unit-sphere $(x_i^2 + y_i^2 + z_i^2 \Leftarrow 1)$.

2. The vertical location ($z_i$) is used to pan the audio signal for object i to each of a number (R) of spatial regions, according to non-repurposable panning curves.
3. Each spatial region (say, region r: $1 \le r \le R$) (which represents the audio components that lie within an annular region of space, as per FIG. 4), is represented in the form of $N_r$ Nominal Speaker Signals, being created using Repurposable Panning Curves that are a function of the azimuth angle of object i ($\phi_i$).

Note that, for the special case of the zero-size ring (the zenith ring, as per FIG. 12), step 3 above is unnecessary, as the ring will contain a maximum of one channel.

Figure 14A:
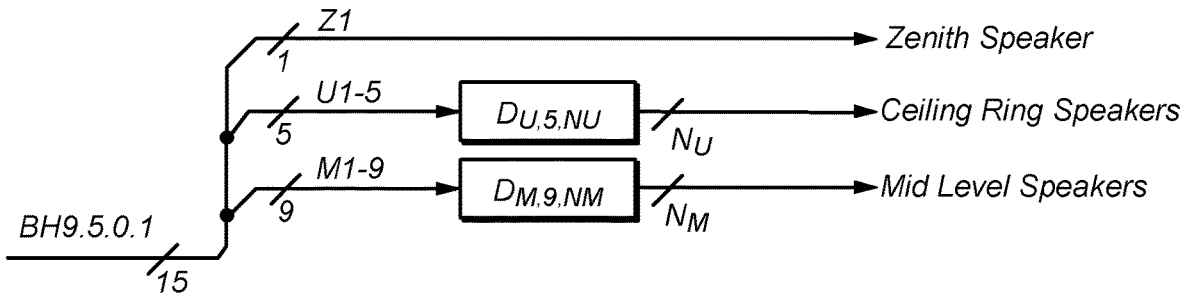
FIGS. 14A-C illustrate the decoding of the Stacked-Ring Intermediate Spatial Format, under different embodiments.
Figure 14B:
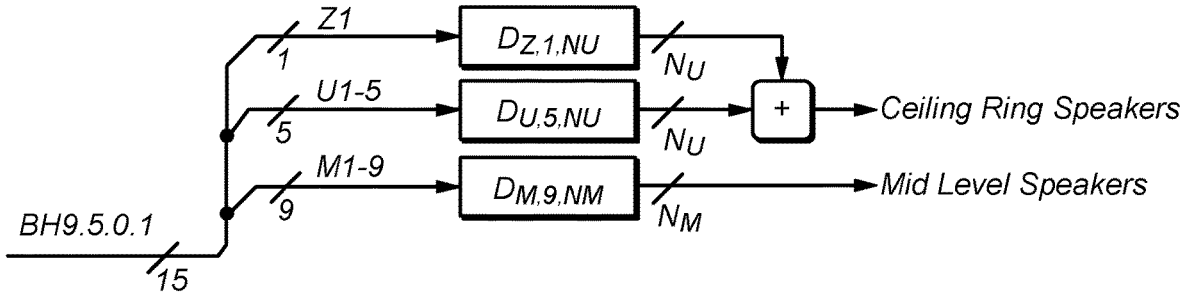
Figure 14C:
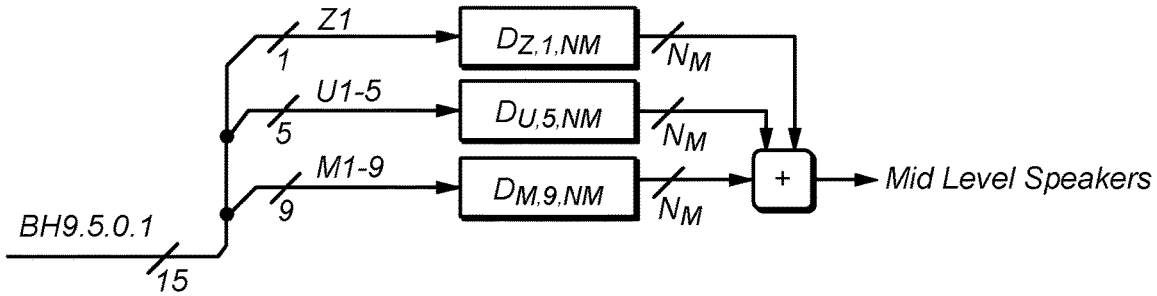

As shown in FIG. 11, the ISF signal 1104 for the K channels is decoded in speaker decoder 1106. FIGS. 14A-C illustrate the decoding of the Stacked-Ring Intermediate Spatial Format, under different embodiments. FIG. 14A illustrates a Stacked Ring Format decoded as separate rings. FIG. 14B illustrates a Stacked Ring Format decoded with no zenith speaker. FIG. 14C illustrates a Stacked Ring Format decoded with no zenith or ceiling speakers.

Although embodiments are described above with respect to ISF objects as one type of object, as compared to dynamic OAMD objects, it should be noted that audio objects formatted in a different format but also distinguishable from dynamic OAMD objects can also be used.

Aspects of the audio environment of described herein represents the playback of the audio or audio/visual content through appropriate speakers and playback devices, and may represent any environment in which a listener is experiencing playback of the captured content, such as a cinema, concert hall, outdoor theater, a home or room, listening booth, car, game console, headphone or headset system, public address (PA) system, or any other playback environment. Although embodiments have been described primarily with respect to examples and implementations in a home theater environment in which the spatial audio content is associated with television content, it should be noted that embodiments may also be implemented in other consumer-based systems, such as games, screening systems, and any other monitor-based A/V system. The spatial audio content comprising object-based audio and channel-based audio may be used in conjunction with any related content (associated audio, video, graphic, etc.), or it may constitute standalone audio content. The playback environment may be any appropriate listening environment from headphones or near field monitors to small or large rooms, cars, open air arenas, concert halls, and so on.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Reference throughout this specification to "one embodiment", "some embodiments" or "an embodiment" means that a particular feature, structure or characteristic described in connection with the embodiment is included in at least one embodiment of the discloses system(s) and method(s). Thus, appearances of the phrases "in one embodiment", "in some embodiments" or "in an embodiment" in various places throughout this description may or may not necessarily refer to the same embodiment. Furthermore, the particular features, structures, or characteristics may be combined in any suitable manner as would be apparent to one of ordinary skill in the art.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of rendering adaptive audio, comprising:

receiving input audio comprising static channel-based audio and at least a dynamic object, wherein the dynamic object is classified as either a low-priority dynamic object or a high-priority dynamic object based on a priority value;

rendering the low-priority dynamic object using a first rendering process and rendering the high-priority object using a second rendering process, wherein the first rendering process is different than the second rendering process for high priority objects based on a respective processing capability provided to each of the first rendering process and the second rendering process, wherein the rendering includes classifying the dynamic object as either a low-priority object or a high-priority object based on a comparison of the priority value with a priority threshold value, and wherein the rendering includes choosing either the first rendering process or the second rendering process based on the classification, and rendering the channel-based audio independent of the classification.

2. The method of claim 1, wherein the input audio is formatted in accordance with an object audio based digital bitstream format including audio content and rendering metadata.

3. The method of claim 1, wherein the channel-based audio comprises surround-sound audio beds, and audio objects conforming to an intermediate spatial format, and rendering the channel-based audio using the first rendering process.

4. The method of claim 3, wherein the first rendering process is performed in a first rendering processor that is optimized to render channel-based audio and static objects; and the second rendering process is performed in a second rendering processor that is optimized to render high priority dynamic objects by at least one of an increased performance capability, an increased memory bandwidth, and an increased transmission bandwidth of the second rendering processor relative to the first rendering processor.

5. The method of claim 4, wherein the first rendering processor and the second rendering processor are implemented as separate rendering digital signal processors (DSPs) coupled to one another over a transmission link.

6. The method of claim 1, further including post-processing the rendered audio for transmission to a speaker system.

7. The method of claim 6, wherein the post-processing step comprises at least one of upmixing, volume control, equalization, and bass management.

8. The method of claim 7, wherein the post-processing step further comprises a virtualization step to facilitate the rendering of height cues present in the input audio for playback through the speaker system.

9. The method of claim 1, wherein the priority threshold value is defined by one of: a preset value, a user selected value, and an automated process.

10. A non-transitory computer readable storage medium containing instructions that when executed by a processor perform a method according to claim 1.

11. The method of claim 1 wherein the high-priority audio objects may be determined by their respective position in the object audio metadata bitstream.

12. A system for rendering adaptive audio, comprising:

an interface receiving input audio in a bitstream having audio content and associated metadata, the audio content comprising dynamic objects, wherein the dynamic objects are classified as low-priority dynamic objects and high-priority dynamic objects;

a rendering processor coupled to the interface and configured to render the dynamic object, wherein low-priority objects are rendered using a first rendering process and high-priority objects are rendered using a second rendering process, wherein the first rendering process is different than the second rendering process based on a respective processing capability provided to each of the first rendering process and the second rendering process, wherein the rendering includes classifying the dynamic object as either a low-priority object or a high-priority object based on a comparison of a priority value with a priority threshold value, and wherein the rendering includes choosing either the first rendering process or the second rendering process based on the classification.

13. The system of claim 12, wherein the input audio is formatted in accordance with an object audio based digital bitstream format including audio content and rendering metadata.

14. The system of claim 12, further comprising receiving channel-based audio comprising surround-sound audio beds, and audio objects conforming to an intermediate spatial format, and further comprising rendering the channel-based audio using the first rendering process.

15. The system of claim 12, wherein the processor is further configured to post-process the rendered audio for transmission to a speaker system.

16. The system of claim 15, wherein the post-processing comprises at least one of upmixing, volume control, equalization, and bass management.

17. The system of claim 16, wherein the post-processing further comprises a virtualization step to facilitate the rendering of height cues present in the input audio for playback through the speaker system.

18. The system of claim 12, further comprising a first rendering processor for processing a first priority type of audio component, wherein the first rendering processor is optimized to render low priority dynamic objects, channel-based audio and static objects, and wherein the processor is configured to render a second priority type of audio component, wherein the second rendering processor is optimized to render high priority dynamic objects by at least one of an increased performance capability, an increased memory bandwidth, and an increased transmission bandwidth of the second rendering processor relative to the first rendering processor.

19. The system of claim 18, wherein the first rendering processor and the processor are implemented as separate rendering digital signal processors (DSPs) coupled to one another over a transmission link.

20. The system of claim 12, wherein the priority threshold value is defined by one of: a preset value, a user selected value, and an automated process.

* * * * *